United States Patent [19]

Schwab

[11] 4,315,328

[45] Feb. 9, 1982

[54] BATTERY-DRIVEN CLOCK WITH INDICATOR OF THE END OF LIFE OF THE BATTERY

[75] Inventor: Jean-Francois Schwab, Schwalbach, Switzerland

[73] Assignee: Quarz-Zeit AG, Frankfurt am Main, Fed. Rep. of Germany

[21] Appl. No.: 19,817

[22] Filed: Mar. 12, 1979

[30] Foreign Application Priority Data

Mar. 16, 1978 [DE] Fed. Rep. of Germany ..... 2811391

[51] Int. Cl.[3] ..... G04B 9/00; G04B 19/04

[52] U.S. Cl. ..... 368/66; 368/80

[58] Field of Search ..... 58/4 A, 23 BA, 23 C, 58/50 R, 152 H; 340/636, 662, 663; 368/66

[56] References Cited

U.S. PATENT DOCUMENTS

| | | | |
|---|---|---|---|
| 3,898,790 | 8/1972 | Takamane et al. | 58/152 H X |
| 3,991,553 | 11/1976 | Bergey et al. | 58/152 H |
| 3,998,043 | 12/1976 | Tamaru et al. | 368/66 |
| 4,014,164 | 3/1977 | Fujita | 58/152 H |
| 4,090,355 | 5/1978 | Morohoshi | 58/130 E |

*Primary Examiner*—Vit W. Miska

*Attorney, Agent, or Firm*—Martin A. Farber

[57] ABSTRACT

A battery-driven clock with a timing stage which emits a control signal of a certain frequency to an electromechanical or electronic indicator stage, and a warning stage establishing the end of the service life of the battery. In the warning situation the warning stage influences the frequency of the control signal in the sense of advancing the clock.

11 Claims, 2 Drawing Figures

BATTERY-DRIVEN CLOCK WITH INDICATOR OF THE END OF LIFE OF THE BATTERY

FIELD OF THE INVENTION

The invention relates to a battery-driven clock with a timing stage which emits a control signal of a certain frequency to an electromechanical or electronic indicator stage, and a warning stage establishing the end of the service life of the battery.

STATE OF THE ART

With battery-driven clocks or watches it can happen that the battery dies out unnoticed and the clock thus suddenly stops. In order to prevent this, it is known to provide the watch or clock with a warning (alarm) stage which ascertains the end of the service life of the battery. With one known clock the warning stage comprises a device which detects the voltage of the battery, which device acts on an electromechanical system upon dropping of the battery voltage under a certain pre-given value, and which points out to the user of the clock that the end of the service life of the battery is reached. With another known clock the indication of the end of the battery service life is brought about by means of a liquid-crystal display or indicator. These known clocks have the disadvantage that the indicator device for the battery service life either is costly in terms of constructional components and has a comparatively large spacial requirement or for this, additional electrical energy is required, so that the battery service life which remains after placing the indicator device in operation is sharply shortened.

OBJECT OF INVENTION

These disadvantages are to be avoided by the invention. It is therefore an object of the invention to make a clock with a warning stage which ascertains the end of the service life of the battery, and which warning stage needs as few additional components as possible and even in the warning situation has no, or in any case a negligibly small, power consumption.

SUMMARY OF THE INVENTION

This object is aided in its solution in accordance with another object of the invention in the manner that in the warning situation the warning stage influences the frequency of the control signal in the sense of an advance of the clock.

ADVANTAGES OF THE INVENTION

The invention starts out from the known fact that battery-driven clocks or watches and particularly battery-driven quartz clocks or watches run very exact even over a long period of time and in any event if need be deviations from the normal time occur in the range of seconds. Consequently to a user of such a clock it is conspicuous if the clock suddenly advances by a noticeable or characteristic amount, so that such an advance can be utilized as criterion for the imminent or near end of the battery service life. By the use of the actual clock time indication for the indication of the end of the service life of the battery, an additional indication or signal can be completely eliminated, which not only positively effects the power consumption but also has a positive effect on the spacial requirement of the warning device. Moreover the influencing of the frequency of the control signal may be carried out with an exceptionally small power consumption, whereby the latter drops to a negligibly small value if a timing stage is used with a quartz oscillator and a divider connected following the latter. A particular advantage of the invention is that the elements of the warning stage can be combined or assembled with the other components of the timer stage in a single integrated IC circuit which has an extremely favorable effect on the production or manufacturing costs.

FURTHER FEATURES AND ADVANTAGES OF THE INVENTION

According to an advantageous embodiment of the invention an alarm or warning stage (8,8') is provided, which momentarily or for a short time increases the frequency such that the clock advances by a predetermined amount per unit time. With such an embodiment the frequency of the control signal is influenced only once during a short time period and to an extent indeed such that the clock noticeably advances, for example, five or ten minutes. The advantage of such an embodiment is that no measureable additional power consumption occurs. Of a certain disadvantage is that after a correction of the clock, the user can again forget the indication which was provided by the advance.

This disadvantage does not occur with another embodiment in which a warning stage is provided which increases the frequency up to the end of the battery service life, such that the clock advances by a certain constant amount each time after respectively a certain time duration. With this embodiment thus the frequency increases compared to the normal frequency up to the end of the battery service life, so that the clock again advances even after a correction after a certain time duration. Beyond that the amount of the advance increases by constant amounts per time duration, thus, for example, by five or ten minutes daily.

The influencing of the frequency of the control signal by the warning stage can occur continuously according to one embodiment of the invention or even intermittently according to another embodiment form of the invention. Which of the two possibilities is finally realized depends essentially if a frequency which is increased compared to the normal frequency is available of such frequency values that the desired extent of the advance of the clock is achieved. If this frequency is not available, or if it can only be obtained or realized with considerable difficulties, then by the use of a frequency with a per se unsuitable frequency value and corresponding intermittent application of the indicator stage, the desired extent of the advance can be achieved.

According to another embodiment form of the invention a warning stage (8,8') is provided which increases the frequency in time dependency on the remaining battery service life, such that the clock advances with an increasing amount per unit time. With such an embodiment thus the clock advances more per unit time the closer the end of the battery service life is. In this manner the user gets a new indication or sign of the urgency of replacing the battery with a new one. It has proven suitable to increase the frequency in stages or steps, since with such a measure simpler technical manufacturing or production advantages may be realized than with a stepless or continuous increase.

It has proven suitable to construct the warning stage such that the latter executes a frequency change which causes an advance of the clock by a few minutes each day (per 24 hours). Tests have shown that an advance of the clock by five minutes per 24 hour period is of particular value with reference to the further use of the clock for the reading of the prevailing clock time.

With a clock with a timing stage, with the latter containing a quartz oscillator and a divider connected to the oscillator in series, the warning stage (8,8') can be realized in a simple manner by at least one threshold limit value switch (9) which responds to at least one predetermined operating voltage value and switches or connects at least one output of the divider (3) directly or indirectly to the indicator stage (4). Should the warning stage respond to several battery voltage values, thus either several threshold value switches can be provided, of which each respectively is associated or coordinated to a certain operating voltage value, or one threshold value switch is provided which is constructed such that it is in a position to respond at several threshold limit values. For achieving a frequency which is desired for a certain advance of the clock when this frequency does not occur at one of the outputs of the divider, the frequency signals of several outputs of the divider can be mixed. Another possibility is to connect the divider output indirectly with the indicator stage (4) by means of a monostable multivibrator. By a corresponding regulation control or adjustment of the flipping time an output frequency can then be achieved, which output frequency is independent of the input frequency of the multivibrator.

BRIEF DESCRIPTION OF THE FIGURES

With the above and other objects and advantages in view, the present invention will become more clearly understood in connection with the detailed description of preferred embodiments, when considered with the accompanying drawing, of which.

DETAILED DESCRIPTION OF PREFERRED EMBODIMENTS

Figure 1:
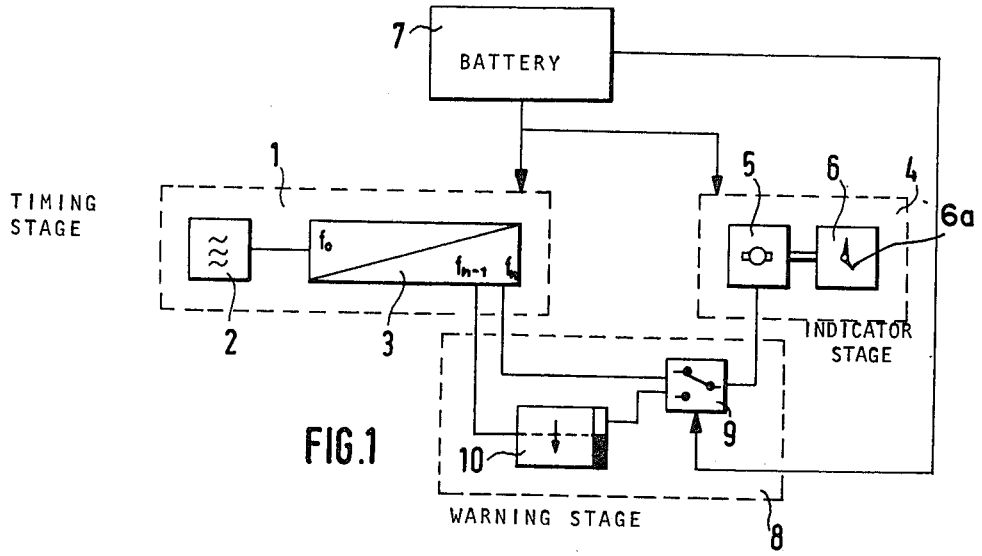
FIG. 1 is a block schematic diagram of a clock with a warning stage containing a monostable multivibrator in accordance with the invention.

Referring now to the drawing and more particularly to FIG. 1, the watch or clock contains a timer or time-producing or -generating stage 1, which is constructed from a quartz oscillator 2 and a frequency divider 3, and an electromechanical indicator stage 4 with a single phase stepping motor 5 and an analog clockwork dial train 6, with clock hands *6a*, the latter being driven by the single phase stepping motor 5. A battery 7 is provided for the current supply for the timer stage 1 and the indicator stage 4.

For detecting the approaching end of the service life of the battery 7, a warning stage 8 is provided which contains a threshold limit switch 9 with the clock according to FIG. 1. This switch 9 is operatively connected to the battery 7 and responds or is actuated upon dropping of the battery voltage to a certain predetermined value. In the normal case the threshold value switch 9 is in the switch position which connects the seconds pulses output of the frequency divider 3 (i.e., that output which emits seconds pulses) with the excitation coil of the single phase stepping motor 5, so that the rotor of the stepping motor moves with seconds steps (i.e., a step each second) and the hours-, minutes- and seconds- indicator which stands in connection with the motor over the clockwork movement or gear train moves in the correct time. (Although not limited thereto as an example a stepping motor which may be utilized is described in application Ser. no. 902,435, filed May 3, 1978, by the same applicant and commonly assigned, disclosure of this application hereby being incorporated by reference herein.)

As soon as the voltage of the battery drops under a certain predetermined value, the threshold value switch 9 responds and the switch 9 switches and now connects another output of the frequency divider 3 with the excitation coil of the single phase stepping motor 5. A monostable multivibrator 10 follows connected to this output of the frequency divider 3. This additional output of the frequency divider 3 emits a signal with a higher frequency compared to the previous first-mentioned frequency divider output. In connection with this, by a regulation or adjustment of the flipping-back time of the monostable multivibrator 10 which is interconnected between this output of the frequency divider 3 and the other input of the switch, the frequency of the signal (which signal is emitted from the output of the frequency divider 3 and is fed to the input of the monostable multivibrator 10) can be changed within limits such that the excitation coil or winding of the single phase stepping motor 5 is applied with a frequency signal which leads to an advance of the clock by a few minutes per day (24 hour period). With this embodiment the frequency of the control signal which is fed to the excitation winding of the single phase stepping motor 5 changes continuously and until the end of the battery service life.

Figure 2:
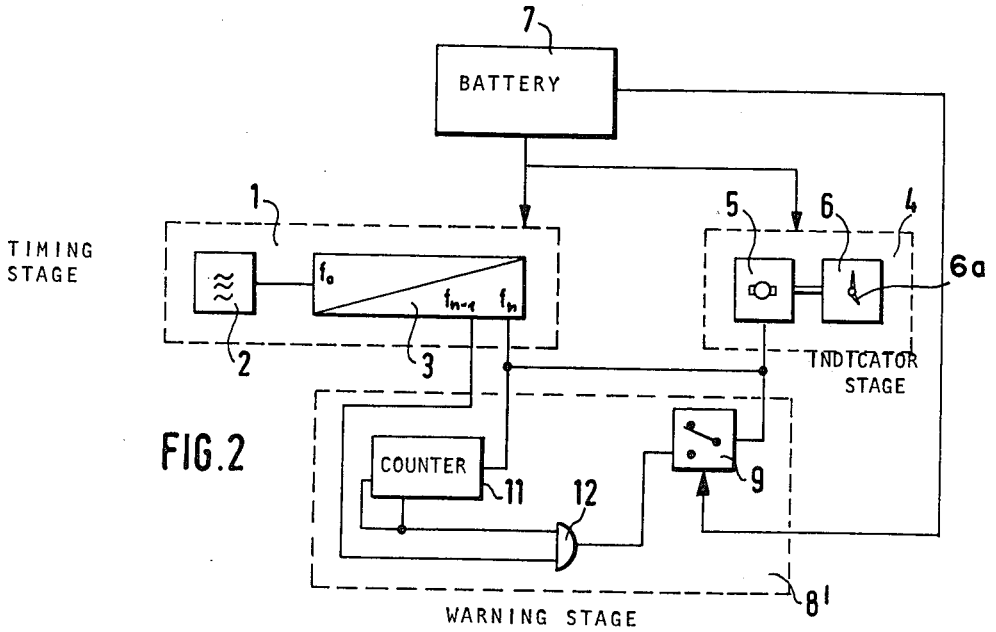
FIG. 2 is a block circuit diagram of a clock with a warning stage containing a counter in accordance with the invention.

With the clock according to FIG. 2, a warning stage 8' is present which moreover contains a threshold limit switch 9 which responds by switching upon dropping of the battery voltage to a certain predetermined value and the excitation winding of the single phase stepping motor 5 is applied with a signal of a higher frequency. For the production of this signal, a counter 11 is provided, the counting input of which is connected with one output of the frequency divider 3, the latter mentioned output emitting the normal frequency control signal ($f_n$), and the counter 11 being connected with one of its outputs to one input of a conjunction (AND gate) member 12. The other input of the conjunction member 12 is connected with a higher frequency output ($f_{n-1}$) of the frequency divider 3. Each time when the counter has reached the predetermined counter contents, it emits a signal to the conjunction member 12, whih member 12 during a short time transmits the higher frequency output ($f_{n-1}$) of the frequency divider 3 via the switched threshold value switch 9 to the excitation winding 5 of the single phase stepping motor 5. The signal (which controls the conjunction member 12) of the counter moreover is also used for setting the counter to zero (as illustrated), whereupon the counter begins to count anew until the predetermined counter contents is reached. With this embodiment the frequency of the control signal which is fed to the single phase stepping motor 5 is influenced intermittently and indeed until the end of the battery service life. If an increase of the frequency is desired in time dependency on the remaining battery service life, so this can be realized with an embodiment form in a simple manner, in that with the battery service life becoming shorter, timewise successive counter outputs which are associated with smaller counter contents, respectively, are operatively switched or connected into operation so that already upon reaching a smaller counter contents the conjunction member 12 is switched into a flow passage direction into conduction. The operative switching of the individual counter outputs, which operative switching is performed in time dependency on the remaining battery service life, can take place by means of correspondingly controlled or adjusted threshold value switches, which are triggered or driven by the battery.

While there have been disclosed several embodiments of the invention it is to be understood that these embodiments are given by example only and not in a limiting sense.

I claim:

1. A clock driven by a battery comprising a timing stage means for emitting a control signal of a certain frequency, an electric indicator stage operatively connected to said timing stage means so as to receive said control signal and to indicate the clock time, a warning stage means for detecting an approaching end of the service life of the battery constituting a warning situation, said warning stage means for influencing the frequency of said control signal so as to advance the clock time indicated by the indicator stage in the warning situation, said indicator stage is an analog clock comprising clock hands, said clock hands constituting means for indicating the clock time as well as the advanced clock time in said warning situation, respectively, in response to said control signal, said warning stage means is for increasing the frequency until the end of the battery service life, such that after a predetermined time duration respectively the clock advances by a certain constant amount.

2. The battery-driven clock as set forth in claim 1, wherein said warning stage means is for influencing the frequency continuously.

3. The battery-driven clock as set forth in claim 1, wherein said warning stage means is for influencing the frequency intermittently.

4. A clock driven by a battery comprising a timing stage means for emitting a control signal of a certain frequency, an electric indicator stage operatively connected to said timing stage means so as to receive said control signal and to indicate the clock time, a warning stage means for detecting an approaching end of the service life of the battery constituting a warning situation, said warning stage means for influencing the frequency of said control signal so as to advance the clock time indicated by the indicator stage in the warning situation, said indicator stage is an analog clock comprising clock hands, said clock hands constituting means for indicating the clock time as well as the advanced clock time in said warning situation, respectively, in response to said control signal, said warning stage means is for increasing the frequency in time dependency on the remaining battery service life, such that the clock advances with an increasing amount per unit time.

5. The battery-driven clock as set forth in claim 4, wherein said warning stage means increases the frequency in steps.

6. A clock driven by a battery comprising a timing stage means for emitting a control signal of a certain frequency, an electric indicator stage operatively connected to said timing stage means so as to receive said control signal and to indicate the clock time, a warning stage means for detecting an approaching end of the service life of the battery constituting a warning situation, said warning stage means for influencing the frequency of said control signal so as to advance the clock time indicated by the indicator stage in the warning situation, said indicator stage is an analog clock comprising clock hands, said clock hands constituting means for indicating the clock time as well as the advanced clock time in said warning situation, respectively, in response to said control signal, said warning stage means is for executing a frequency change which advances the clock a few minutes each 24 hour period.

7. The battery-driven clock as set forth in claim 6, wherein said warning stage means is for performing a frequency change which advances the clock by five minutes each 24 hour period.

8. A clock driven by a battery comprising a timing stage means for emitting a control signal of a certain frequency, an electric indicator stage operatively connected to said timing stage means so as to receive said control signal and to indicate the clock time, a warning stage means for detecting an approaching end of the service life of the battery constituting a warning situation, said warning stage means for influencing the frequency of said control signal so as to advance the clock time indicated by the indicator stage in the warning situation, said timing stage means includes a quartz oscillator and a frequency divider following and operatively connected to said oscillator, said warning stage means contains at least one threshold value switch means for responding to at least one predetermined operating voltage value of the battery for switching at least one output of the frequency divider to said indicator stage, said warning stage means includes, a monostable multivibrator indirectly which connects another output of the frequency divider with said indicator stage via said threshold value switch means.

9. A clock driven by a battery comprising a timing stage means for emitting a control signal of a certain frequency, an electric indicator stage operatively connected to said timing stage means so as to receive said control signal and to indicate the clock time, a warning stage means for detecting an approaching end of the service life of the battery constituting a warning situation, said warning stage means for influencing the frequency of said control signal so as to advance the clock time indicated by the indicator stage in the warning situation, said timing stage means includes a quartz oscillator and a frequency divider following and operatively connected to said oscillator, said warning stage means contains at least one threshold value switch means for responding to at least one predetermined operating voltage value of the battery for switching at least one output of the frequency divider to said indicator stage, said warning stage means includes, counter means for providing an output upon reaching a predetermined content, said counter means having a counting input connected to a normal frequency control signal output of said frequency divider, an AND gate having inputs connected to the output of said counter means and to another output of said frequency divider, respectively, said another output of said frequency divider having a higher frequency than that of said normal frequency control signal output, said AND gate has an output operatively connected to said threshold value switch means, said normal frequency control signal output of said frequency divider is directly connected to said indicator stage.

10. The battery-driven clock as set forth in claim 9, wherein said output of said counter means is further connected to a resetting input of said counter means.

11. The battery driven clock as set forth in claim 8 or 9, wherein said indicator stage is an analog clock with means comprising clock hands, said clock hands constituting means for the indicating of the clock time as well as the advanced clock time in said warning situation, respectively, in response to said control signal.

* * * * *